US010463093B2

(12) United States Patent
Matthews

(10) Patent No.: US 10,463,093 B2
(45) **Date of Patent: *Nov. 5, 2019**

(54) GARMENT ASSEMBLY WITH DEPLOYABLE SEAT

(71) Applicant: Cabela's LLC, Sidney, NE (US)

(72) Inventor: Kevin L. Matthews, Sidney, NE (US)

(73) Assignee: CABELA'S LLC, Sidney, NE (US)

( * ) Notice: Subject to any disclaimer, the term of this patent is extended or adjusted under 35 U.S.C. 154(b) by 319 days.

This patent is subject to a terminal disclaimer.

(21) Appl. No.: 14/484,175

(22) Filed: Sep. 11, 2014

(65) Prior Publication Data

US 2014/0373249 A1 Dec. 25, 2014

Related U.S. Application Data

(63) Continuation of application No. 13/231,432, filed on Sep. 13, 2011, now Pat. No. 10,376,002, which is a (Continued)

(51) Int. Cl.
*A41D 15/04* (2006.01)
*A45F 5/02* (2006.01)
(Continued)

(52) U.S. Cl.
CPC ..... *A41D 15/04* (2013.01); *A41D 1/04* (2013.01); *A45F 5/02* (2013.01); *A47C 3/16* (2013.01);
(Continued)

(58) Field of Classification Search
CPC .... A41D 15/04; A41D 1/04; A41D 2600/108; A47C 13/00; A47C 9/10; A47C 3/18;
(Continued)

(56) References Cited

U.S. PATENT DOCUMENTS 1,626,166 A * 4/1927 Stair ..... 2/94
1,723,831 A * 8/1929 Weymouth ..... 297/4
(Continued)

OTHER PUBLICATIONS

Non-final Office Action dated May 22, 2018 issued in corresponding U.S. Appl. No. 13/231,432.

*Primary Examiner* — Alissa L Hoey
(74) *Attorney, Agent, or Firm* — Pillsbury Winthrop Shaw Pittman LLP

(57) ABSTRACT

A garment assembly includes a garment and a seat. The seat includes a front surface, a rear surface, a first side surface and a second side surface and defines an aperture that extends through the seat from the first side surface to the second side surface. The assembly further includes an at least partially elastic member including a first end section attached to the garment, a second end section attached to the garment, and an intermediate section extending through the seat aperture. At least one of the first end section and the second end section are elastic, and the intermediate section is elastic, such that the seat is deployable between a stowed position and a deployed position and exterior to the garment in the stowed and deployed position. The seat is configured to extend substantially vertical while stowed and substantially horizontal while deployed.

18 Claims, 4 Drawing Sheets

Related U.S. Application Data continuation of application No. 11/778,134, filed on Jul. 16, 2007, now Pat. No. 8,032,949.

(60) Provisional application No. 60/820,531, filed on Jul. 27, 2006.

(51) Int. Cl.

| | |
|---|---|
| ***A47C 3/16*** | (2006.01) |
| ***A47C 9/10*** | (2006.01) |
| ***A41D 1/04*** | (2006.01) |
| ***A47C 13/00*** | (2006.01) |

(52) U.S. Cl.
CPC ..... *A47C 9/10* (2013.01); *A47C 13/00* (2013.01); *A41D 2600/108* (2013.01)

(58) Field of Classification Search
CPC ..... A47C 4/52; A45F 5/02; A45F 4/00; A47D 3/16; A45C 9/00
USPC ..... 2/69, 84
See application file for complete search history.

(56) References Cited

U.S. PATENT DOCUMENTS

| | | | | | |
|---|---|---|---|---|---|
| 2,661,474 | A | * | 12/1953 | Tate | 2/94 |
| 2,736,030 | A | * | 2/1956 | Moody | 2/94 |
| 3,708,799 | A | * | 1/1973 | Smithdeal | 2/46 |
| 4,025,105 | A | * | 5/1977 | Pekala | 297/4 |
| 4,588,224 | A | * | 5/1986 | Hill, Jr. | 297/4 |
| 4,735,423 | A | * | 4/1988 | Foss | 280/18 |
| 4,928,793 | A | * | 5/1990 | Westimayer et al. | 182/187 |
| 4,955,665 | A | * | 9/1990 | Richer | 297/4 |
| 5,086,514 | A | * | 2/1992 | Ross | 2/467 |
| 5,101,514 | A | * | 4/1992 | Eklund | 2/94 |
| 5,190,350 | A | * | 3/1993 | Hwang et al. | 297/380 |
| 5,271,659 | A | * | 12/1993 | Zinkevicz | 297/4 |
| 5,275,315 | A | * | 1/1994 | Carmack et al. | 224/576 |
| 5,560,524 | A | * | 10/1996 | Brune | 224/155 |
| 5,620,227 | A | * | 4/1997 | Brune | 297/4 |
| 5,819,999 | A | * | 10/1998 | Tennant | 224/155 |
| 5,957,349 | A | * | 9/1999 | Krulik | 224/155 |
| 5,988,465 | A | * | 11/1999 | Vitale et al. | 224/155 |
| 6,007,572 | A | * | 12/1999 | Baldwin | 607/114 |
| 6,010,183 | A | * | 1/2000 | Perkins | 297/4 |
| 6,175,959 | B1 | * | 1/2001 | Somers | 2/46 |
| 6,256,791 | B1 | * | 7/2001 | Callahan | 2/102 |
| 6,347,406 | B1 | * | 2/2002 | Jones et al. | 2/69 |
| 6,772,925 | B2 | * | 8/2004 | O'Hare | 224/155 |
| 6,848,746 | B2 | * | 2/2005 | Gentry | 297/380 |
| 6,918,465 | B2 | * | 7/2005 | Eastman, II | 182/187 |
| 7,093,413 | B1 | * | 8/2006 | Hughes | 54/44.1 |
| 8,032,949 | B1 | * | 10/2011 | Matthews | 2/94 |
| 2007/0012735 | A1 | * | 1/2007 | Lee et al. | 224/155 |
| 2008/0122267 | A1 | * | 5/2008 | Larson et al. | 297/4 |

* cited by examiner

GARMENT ASSEMBLY WITH DEPLOYABLE SEAT

PRIORITY CLAIM

This application is a continuation of and claims the benefit of and priority to U.S. Non-Provisional patent application Ser. No. 13/231,432, filed on Sep. 13, 2011, which is a continuation of and claims the benefit of and priority to U.S. Non-Provisional patent application Ser. No. 11/778,134, filed on Jul. 16, 2007, which claims priority to and the benefit of U.S. Provisional Patent Application Ser. No. 60/820,531, filed on Jul. 27, 2006, the entire contents of which are incorporated herein by reference.

BACKGROUND

The present invention generally relates to garments and, more particularly, to garments that incorporate a seat.

Hunting vests or the like exist that incorporate a seat. Various strap with buckles, retain the seat in a stowed position on the rear or back side of the vest using one or more straps. When use of the seat is desired, one or more of the straps may be unhooked or unbuckled. Each of the straps also may be unhooked or unbuckled to totally disconnect the seat from the hunting vest. In any case, the hunter typically either grasps the seat and holds the same against his/her butt and sits down on the seat, or the hunter manually places the seat onto the relevant supporting structure (e.g., the ground) and then sits on the same.

Although the above-noted type of hunting vest offers certain advantages, noise is a concern when disconnecting the seat from the hunting vest for subsequent use. Operating the buckles/hooks may spook nearby game. Also, in many cases a hunter will want to move very short distances after getting situated. This of course requires the hunter to manually move the seat. If the hunter is going to move any significant distance, the hunter will typically manually reattach the seat to the hunting vest. This is time consuming and also generates undesired noise through engagement of buckles or the like. There is also of course the risk that the hunter will forget the disconnected seat when moving as well.

SUMMARY

A first aspect of the present invention is generally directed to a garment assembly. This garment assembly includes a garment, a seat, and at least one elastic member that interconnects the garment and the seat.

Various refinements exist of the features noted in relation to the first aspect of the present invention. Further features may also be incorporated in the first aspect of the present invention as well. These refinements and additional features may exist individually or in any combination. The garment may be of any appropriate size, shape, configuration, and/or type. For instance, the garment may be in the form of a jacket, a vest, a life jacket, a shirt, a coat, a parka, a backpack, or a sporting event seat. The garment may also be used for any appropriate application, such as hunting, fishing, boating, camping, hiking, attending sporting events, or the like. The garment may include any feature or combination of features for the relevant application (e.g., pockets, shell holders). The seat also may be detachably interconnected with the garment so as to be totally separable from the garment, or the seat may somehow remain interconnected with the garment at all times.

First and second elastic strap sections may interconnect the seat and the garment in the case of the first aspect. One portion of each of these first and second elastic strap sections may be attached or fixed at any appropriate location and in any appropriate manner to the garment (e.g., an end of the first and second elastic strap sections). Another portion of each of the first and second elastic strap sections may be associated with first and second sides, respectively, of the seat. For instance, the first and second elastic strap sections may be part of a single strap that extends side-to-side through the interior of the seat. In this case, the first and second elastic strap sections may not in fact be attached or fixed to the seat, but would appropriately interface or interact with the seat. However, the first and second elastic strap sections could in fact be attached or fixed to the seat in any appropriate manner and at any appropriate location (e.g., the first and second strap sections may be separate structures), for instance at or near the opposing sides of the seat. In any case, a separate buckle or the like may be associated with each of the first and second elastic strap sections to facilitate the detachable interconnection of the seat with the garment if desired/required.

Generally, the above-noted first and second elastic strap sections may stretch or extend to accommodate movement of the seat from a stowed position to a deployed position in the case of the first aspect. As will be discussed in more detail below in relation to the second aspect of the present invention, this movement may be characterized as a pivoting or pivotal-like motion of the seat (e.g., the front of the seat pivoting at least generally about the rear of the seat), as a "flipping" of the seat, or as an inversion of the seat.

Additional straps may be used to interconnect the seat with the garment in the case of the first aspect, although such may not be required in all instances. For instance, two or more straps may engage each of the garment and the seat at or near the rear of the seat. The straps may facilitate movement of the seat from the stowed position to a deployed position in a pivoting or pivotal-like motion, such that these particular straps may be referred to as "hinging" straps or the like. In any case, each of these hinging straps may include a buckle or the like to facilitate the detachable interconnection of the seat with the garment if desired/required.

One function of the elastic member in the case of the first aspect is to facilitate deployment of the seat from a stowed position to a deployed position. Generally, the elastic member may be stretched or extended to move the seat from the stowed position to a deployed position. The elastic member may also resiliently bias the seat into engagement with a user when the seat is in a deployed position (e.g., so as to maintain contact between the seat and a butt of the user, particularly when the user is in a standing position). In any case, movement of the seat between the stowed position and any deployed position does not require disconnecting the seat from the garment in any manner in one embodiment.

A second aspect of the present invention is directed to a method of deploying a seat that is associated with a garment. Movement of the seat from a stowed position to a first deployed position entails stretching or extending at least one interconnection between the seat and garment.

Various refinements exist of the features noted in relation to the second aspect of the present invention. Further features may also be incorporated in the second aspect of the present invention as well. These refinements and additional features may exist individually or in any combination. The garment used by the second aspect may be in accordance with the garment discussed above in relation to the first aspect.

The movement of the seat from the stowed position to a first deployed position in the case of the second aspect may be characterized as a pivoting of the seat, as an inversion of the seat, as a flipping of the seat, or as a movement of a front of the seat at least generally about a rear of the seat. In one embodiment and regardless of the characterization of the type of motion of the seat during deployment, the seat need not be disconnected from the garment to move from a stowed position to a first deployed position. That is, using at least one elastic interconnection between the seat and the garment may be incorporated in a manner that alleviates the need to disconnect the seat in any manner from the garment in order to move the same from a stowed position to a first deployed position. Stated another way, all interconnections that exist between the seat and the garment when the seat is in the stowed position may be maintained as/while the seat is moved from its stowed position to a first deployed position.

The interconnection between the seat and garment may include a first strap that is stretched at least at some point in time during the movement of the seat from its stowed position to a first deployed position in the case of the second aspect. This stretching of the first strap increases its length, and may be followed by a subsequent contraction or retraction of the first strap that in turn decreases its length. In a first embodiment, the length of the strap is increased in moving the seat from its stowed position to an intermediate position (where such an intermediate position is between the stowed position and a first deployed position), and thereafter the length of the first strap is decreased in moving from the intermediate position to a first deployed position. In a second embodiment, the first strap is of a first length when the seat is in the stowed position, the movement of the seat from the stowed position to an intermediate position stretches or extends the first strap to a second length, and the first strap contracts to a third length at least at some point in time during the movement of the seat from the intermediate position to the first deployed position. In this second embodiment, the third length of the first strap (associated with the seat being in a first deployed position) is greater than the first length of the first strap (associated with the seat being in the stowed position), the seat is pulled into contact with a user of the garment by the first strap when the seat is in the first deployed position, or both.

The movement of the seat from the stowed position to a first deployed position may be accommodated by an elasticity or resiliency of at least one interconnection between the seat and the garment in the case of the second aspect. Furthermore, this elasticity or resiliency of at least one interconnection between the seat and the garment in the case of the second aspect may maintain contact between the seat and a user when the seat is in a first deployed position (e.g., at least one interconnection between the seat and the garment may "pull" the seat into contact with the user when the seat is in a first deployed position). This is particularly advantageous when the user moves from a standing position to a seated position, in that the user does not need to hold onto the seat at this time. Moreover, the manner in which the seat may be integrated with the garment (through the use of at least one elastic interconnection) also allows the user to move from a seated position to a standing position, to move to a new location, and then again sit down on the seat as the user does not need to hold onto the seat throughout this time and the seat will simply "follow" the user.

A third aspect of the present invention is directed to a method of deploying a seat that is associated with a garment. The seat is maintained in a stowed position relative to the garment using at least one interconnection between the garment and the seat. However, the seat may be moved from this stowed position to a first deployed position. Notably, each interconnection between the garment and seat (which is used to maintain the seat in the stowed position) may be retained or maintained during movement of the seat from the stowed position to the first deployed position. Therefore, there is no need to disconnect the seat from the garment in any manner when moving the seat from the stowed position to the first deployed position in the case of the third aspect. The various features discussed above in relation to the second aspect may be used by this third aspect, individually or in any combination.

Additional features and advantages are described herein, and will be apparent from the following Detailed Description and the figures.

DETAILED DESCRIPTION

Figure 1:
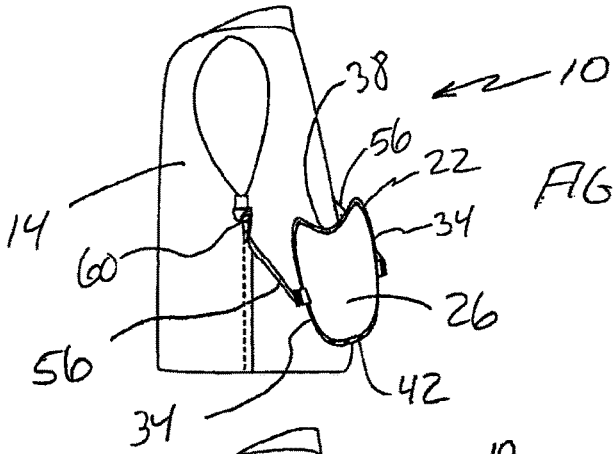
FIG. 1 is a side perspective view of one embodiment of a garment assembly with a deployable seat in a stowed position.

One embodiment of a garment assembly is illustrated in FIGS. 1-4 and is identified by reference numeral 10. The garment assembly 10 includes a garment 14 and a deployable seat 22. The garment 14 may be of any appropriate size, shape, configuration, and/or type, and may be used for any appropriate application (e.g., hunting). For instance, the garment 14 may be in the form of a jacket, vest, life jacket, shirt, coat, parka, backpack, or sporting event seat. In the illustrated embodiment, the garment 14 is in the form of a vest (e.g., a hunting vest).

The deployable seat 22 includes a top or upper surface 26, a bottom or lower surface 30, a pair of side or side surfaces 34, a front or front surface 38, and a rear or rear surface 42. That is, in one embodiment, as shown in FIGS. 1-7, the seat 22 comprises the top surface 26 and the bottom surface 30. As shown in FIG. 7, the top surface 26 of seat 22 is configured to support the user in a seated position thereon when the seat 22 is in use. As shown in FIGS. 1-7, the top surface 26 is generally parallel to the bottom surface 30. Also as shown in FIGS. 1-7 and as to be interpreted herein, generally parallel is defined as being angularly related so as to be more parallel than perpendicular and generally perpendicular is defined as being angularly related so as to be more perpendicular than parallel. The seat 22 may be of any appropriate size, shape, and/or configuration, and may incorporate any appropriate supporting material or combination of supporting materials. Moreover, any desirable properties may be incorporated/utilized by any of the surfaces 26,30, 34,38,42 (e.g., the bottom or lower surface 30 of the seat 22 may be waterproof; the entire exterior of the seat 22 may be waterproof).

A pair of lower strap assemblies or hinging strap assemblies 48 interconnect the garment 14 and the seat 22, and may facilitate the deployment of the seat 22 in a manner that will be discussed in more detail below. Each lower strap assembly 48 may include a buckle 52 (FIGS. 5-7) to facilitate detachably interconnecting the garment 14 and seat 22. Any appropriate number of lower strap assemblies 48 may be used, each lower strap assembly 48 may be fixed at any appropriate location on each of the garment 14 and seat 22 and in any appropriate manner, multiple lower strap assemblies 48 may be disposed in any appropriate arrangement, and each lower strap assembly 48 may use one or more straps of any appropriate type (e.g., elastic; non-elastic). In the illustrated embodiment, each lower strap assembly 48 is fixed to the seat 22 at or near its rear 42. It may be possible to alleviate the lower strap assemblies 48 altogether, although again the use of the lower strap assemblies 48 may facilitate the deployment of the seat 22.

The garment assembly 10 further includes a pair of upper strap sections 56 that each interconnect with the garment 14 and that each at least interface or interact with the seat 22. In the illustrated embodiment, the upper strap sections 56 are actually part of a single strap that extends through the interior of the seat 22 via a side-to-side aperture 44 (FIG. 4) that is incorporated by the seat 22 (e.g., an intermediate section of this single strap extends through the seat 22 and joins with each of the upper strap sections 56). The upper strap sections 56 could also be separate structures and separately attached or fixed to the seat 22 in any appropriate manner and at any appropriate location. In any case, an end of each upper strap section 56 is fixed or mounted to the garment 14 in any appropriate manner and at any appropriate location. In the illustrated embodiment, a buckle 60 is provided for each upper strap section 56 to detachably interconnect the garment 14 with the seat 22 at two additional locations. The upper strap sections 56 and the lower strap assemblies 48 thereby support the seat 22 in its stowed position of FIG. 1. Although the seat 22 may be detachably interconnected with the garment 14 so as to be totally separable from the garment 14 as thus far described, it should be appreciated that at least one interconnection may remain between the seat 22 and the garment 14 at all times (not shown).

Each upper strap section 56 also interfaces with the seat 22 at a pair of laterally spaced locations, or along each of the two sides 34 of the seat 22 as noted. In the illustrated embodiment where the upper strap sections 56 are part of a common strap, the upper strap sections 56 are not actually fixed to the seat 22 as noted. However and once again, it should be appreciated that the upper strap sections 56 could indeed be separate structures, with one portion (e.g., one end) of each such upper strap section 56 being appropriately fixed or mounted to the garment 14 and with another portion.(e.g., the opposite end) of each such upper strap section 56 being appropriately fixed or mounted to the seat 22 in any appropriate manner.

The upper strap sections 56 of the garment assembly 10 facilitate deployment of the seat 22, and notably without having to disconnect the seat 22 from the garment 14 of the garment assembly 10 in any manner. In this regard, the upper strap sections 56 are each able to extend or stretch (i.e., increase in length) some time during deployment of the seat 22. More specifically, each upper strap section 56 extends or stretches (i.e., increases in length) during the initial portion of the deployment of the seat 22, and thereafter may contract (i.e., decreases in length) during a subsequent portion of the deployment of the seat 22. Preferably, each upper strap section 56 is formed from an appropriate elastic or other appropriate resilient material, such that each upper strap section 56 may extend or stretch when exposed to an appropriate force, and thereafter uses stored internal energy or the like to contract or retract to at least some degree upon experiencing at least a certain reduction of this force (including via a pure elastic deformation, where each upper strap section 56 would move back to its undeformed state once a load is totally removed).

Figure 2:
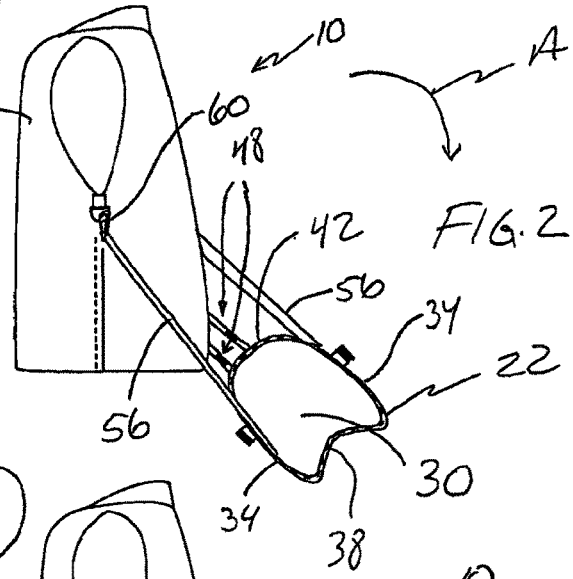
FIG. 2 illustrates the garment assembly of FIG. 1 during deployment of its seat.
Figure 4:
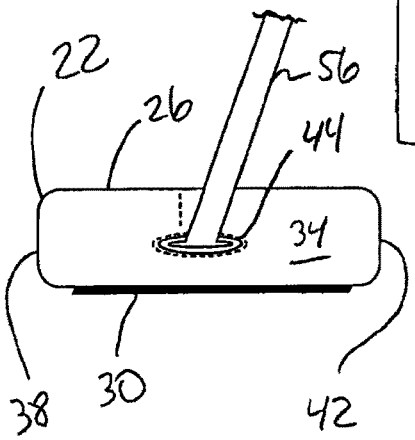
FIG. 4 is an enlarged side view of the seat used by the garment assembly of FIG. 1.
Figure 3:
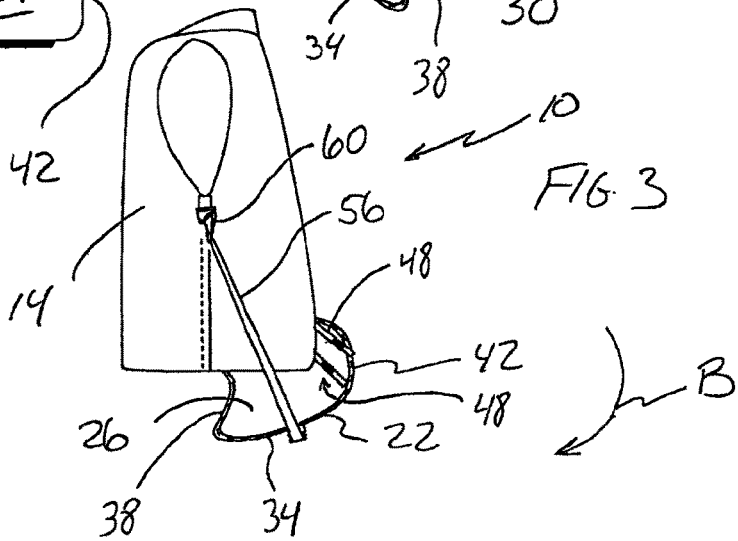
FIG. 3 illustrates the garment assembly of FIG. 1 with its seat in a representative deployed position.

FIGS. 1-3 illustrate three representative positions for the seat 22. FIG. 1 illustrates a stowed position for the seat 22, where the bottom or lower surface 30 of the seat 22 faces the back side of the garment 14 and where the top or upper surface 26 of the seat 22 faces away from the back side of the garment 14. The upper strap sections 56 may "pull" the seat 22 against the garment 14 at this time (e.g., to resiliently bias the seat 22 against the garment 14, particularly when being worn by a user), although such is not required (e.g., the upper strap sections 56 may be in tension or stretched with the seat 22 in its stowed position). FIG. 2 illustrates a representative intermediate position of the seat 22, or a partially deployed position, while FIG. 3 illustrates a representative deployed position of the seat 22 (i.e., other deployed positions may exist). Generally, the seat 22 may be characterized as being pivoted, flipped, or inverted to move from the stowed position of FIG. 1 to the deployed position of FIG. 3 (e.g., the deployment of the seat 22 may be characterized as the front 38 of the seat 22 pivoting at least generally about the rear 42 of the seat 22, as illustrated by the arrows A and B in FIGS. 2 and 3, respectively), and again this motion may be undertaken without disconnecting the seat 22 from the garment 14 in any manner which may be desirable for one or more applications (e.g., hunting).

With the seat 22 being in the stowed position of FIG. 1, the front or front surface 38 of the seat 22 is moved at least generally away from the garment 14 to initiate deployment of the seat 22. Each upper strap section 56 extends or stretches to accommodate movement of the seat 22 from the stowed position of FIG. 1 to the intermediate of FIG. 2. That is, the length of each upper strap section 56 in FIG. 2 is greater than its corresponding length in the stowed position of FIG. 1. Again, note that the seat 22 remains interconnected with the garment 14 by the upper strap sections 56 and the various lower strap assemblies 48.

In order to move the seat 22 from the stowed position of FIG. 1 to the representative deployed position of FIG. 3, the front 38 of the seat 22 is also moved in a downward direction. Compare the vertical position of the front 38 of the seat 22 in each of FIGS. 1 and 2, again where FIG. 2 is an intermediate position of the seat 22 during its deployment. Movement of the seat 22 from the intermediate position of FIG. 2 to the deployed position of FIG. 3 entails directing the front 38 in a continued downward direction and then back toward a position where the seat 22 is now disposed underneath the garment 14 versus "behind" the garment 14 as in the case of the stowed position of FIG. 1. The existence of the lower strap assemblies 48, which again interconnect the seat 22 with the garment 14, may facilitate the above-noted type of motion for deployment of the seat 22 (e.g., a pivoting or pivotal-like motion of the seat 22 at least generally about its rear 42).

In the FIG. 3 position, the upper strap sections 56 may be of an intermediate length compared to the FIGS. 1 and 2 configurations. That is, the upper strap sections 56 may be in an extended or stretched state in FIG. 3 compared to the FIG. 1 position (FIG. 1 being the stowed position), but are contracted or retracted in FIG. 3 (deployed position) compared to the FIG. 2 position (intermediate position). That is, the upper strap sections 56 may and preferably are in tension in the deployed position of FIG. 3, which desirably retains the top or upper surface 26 of the seat 22 against the user. Stated another way, the upper strap sections 56 preferably resiliently bias the seat 22 into contact with a user of the garment assembly 10 with the seat 22 being in the deployed position of FIG. 3.

The above-described motion of the seat 22 during its deployment in effect inverts or flips the seat 22. Recall that in the FIG. 1 position (the stowed position), the bottom or lower surface 30 of the seat 22 faces the garment 14 (in a horizontal dimension), while in the FIG. 3 position (a representative deployed position) the bottom or lower surface 30 of the seat 22 faces away from the garment 14 (in a vertical dimension). Moreover, the top or upper surface 26 of the seat 22 faces away from the garment 14 of the garment assembly 10 in the stowed position of FIG. 1 (facing in a horizontal dimension), but faces the garment 14 in the deployed position of FIG. 3 (facing upwardly in a vertical dimension). It should be appreciated that the above-noted protocol may simply be reversed to move the seat 22 from a deployed position (FIG. 3) back to the stowed position of FIG. 1.

Figure 5:
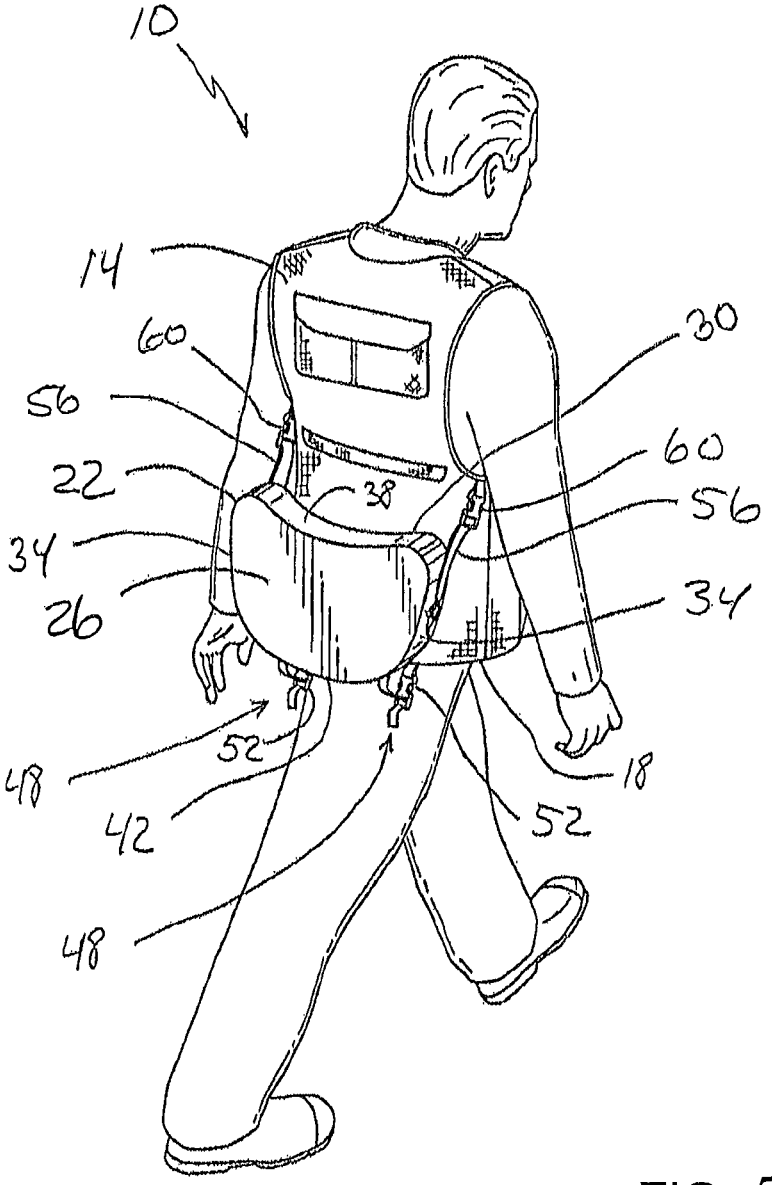
FIG. 5 is a perspective view of the garment assembly of FIG. 1 while being worn by a user and with its seat in a stowed position.
Figure 6:
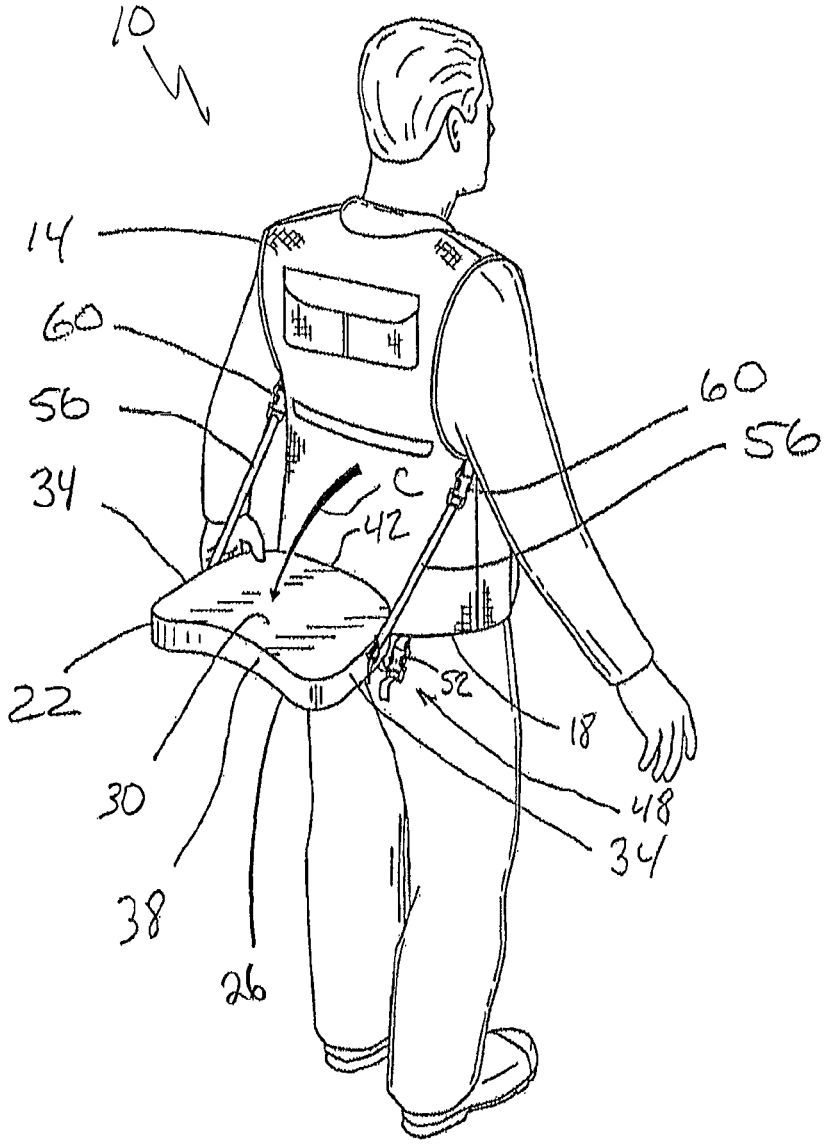
FIG. 6 is a perspective view of the garment assembly of FIG. 5 that illustrates the user initiating deployment of the seat.
Figure 7:
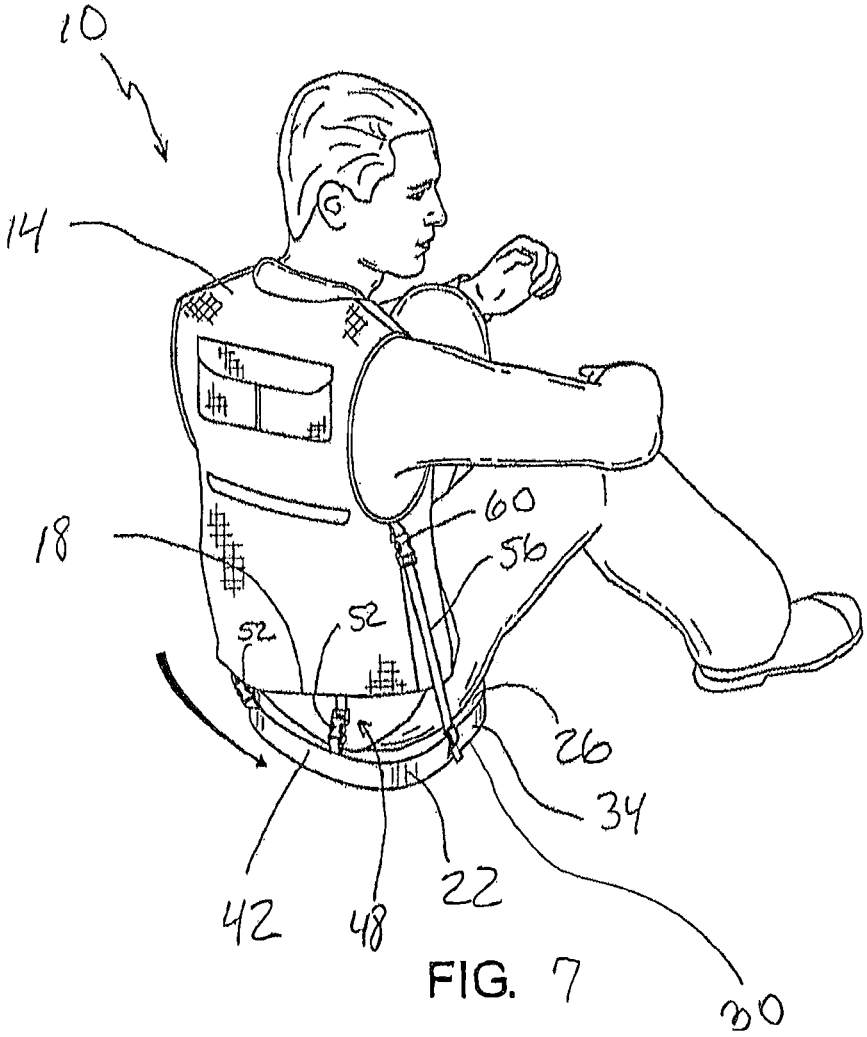
FIG. 7 as a perspective view of the garment assembly of FIG. 5 that illustrates the seat in a representative deployed position and with the user sitting on this seat.

FIGS. 5-7 illustrate three representative positions for the seat 22, with the garment assembly 10 being worn by a user, and with the lower strap assemblies 48 being fixed at or near a lower edge 18 of the garment 14 (although again the lower strap assemblies 48 may be fixed or anchored at any appropriate location of the garment 14 as noted above, and in fact may be alleviated altogether). FIG. 5 is a stowed position for the seat 22, where the bottom or lower surface 30 of the seat 22 faces the garment 14, and where the top or upper surface 26 of the seat 22 faces away from the garment 14 (in a rearward direction in relation to the direction that the user is facing in FIG. 5).

At this time, the upper strap sections 56 may be in tension to "pull" the seat 22 against the back of the user, although again such is not required. Although the lower strap assemblies 48 are not necessarily required, they may enhance the retention of the seat 22 in the stowed position of FIG. 5.

FIG. 6 illustrates the use of a single hand to initiate the deployment of the seat 22 by moving the front 38 of the seat 22 both away from the garment 14 of the garment assembly 10 and in a downward direction, as illustrated by the arrow C. Both of the user's hands could of course be used. This movement of the seat 22 is accommodated by stretching or extending each of the upper strap sections 56 (i.e., the length of the upper strap sections 56 is increased progressing from the stowed position of FIG. 5 to the intermediate position of FIG. 6). The movement of the seat 22 from the FIG. 5 position to the FIG. 6 position exposes the bottom or lower surface 30 of the seat 22 (the bottom 30 now facing "up" in FIG. 6 versus facing the back of the user in the stowed position of FIG. 5), and further changes the orientation of both the top or upper surface 26 of the seat 22 and its bottom or lower surface 30. For instance, the top 26 of the seat 22 faces down in the intermediate position of FIG. 6 (in a vertical dimension), versus facing rear or away from the user in the stowed configuration of FIG. 5 (in a horizontal dimension).

FIG. 7 illustrates a deployed position where the user is sitting on the top or upper surface 26 of the seat 22. In order to dispose the seat 22 in the deployed position of FIG. 7 from the intermediate position of FIG. 6, the user manipulates the seat 22 to move the front 38 of the seat 22 at least generally in the direction depicted by the arrow D in FIG. 7, typically while still in a standing position. In the deployed position of FIG. 7, the upper strap sections 56 are preferably of an intermediate length compared to the configurations of FIGS. 5 and 6. That is, preferably the upper strap sections 56 in FIG. 7 are longer compared to the FIG. 5 configuration (the stowed position for the seat 22), but are shorter compared to the FIG. 6 configuration (an intermediate position in the deployment of the seat 22). As such, the upper strap sections 56 will retract to at least a degree at some point in time of the movement of the seat 22 from the intermediate position of FIG. 6 to the deployed position of FIG. 7 (possibly when the deployed position of FIG. 7 is reached). In any case, the upper strap sections 56 are preferably in tension or stretched to a degree in the deployed position of FIG. 7 to "pull" the seat 22 against the butt of the user, although such may not be required in all instances.

The garment assembly 10 with its deployable seat 22 offers a number of advantages. One is that the user does not have to "unlock" or "unlatch" any buckles to move the seat 22 from the stowed position (e.g., FIG. 5) to a deployed position (e.g., FIG. 7). Unlocking or unlatching buckles generates undesired noise for hunting applications. Stated another way, all structural connections between the seat 22 and the garment 14 of the garment assembly 10 may be retained or maintained while moving the seat 22 between its stowed position and a deployed position. Moreover, the user does not have to hold onto the seat 22 when moving from standing position to a position where the user is sitting on the seat 22, as the upper strap sections 56 may provide a force for retaining the seat 22 against the user at this time. Yet another advantage is that the user may leave the seat 22 in a deployed position when moving from one location to another location. That is, the user may stand up from the position illustrated in FIG. 7 and need not grab the seat 22 to do so—the upper strap sections 56 should retain the top or upper surface 26 of the seat 22 against the butt of the user during the user's transition from the sitting position of FIG. 7 to a standing position. Moreover, the seat 22 may be retained in a deployed position (i.e., the seat 22 need not be moved back to the stowed position of FIG. 5) if the user is moving only a short distance—the upper strap sections 56 again should retain the top or upper surface 26 of the seat 22 against the butt of the user. However, if the user is going to move any significant distance, the foregoing deployment protocol may be reversed to dispose the seat 22 back into the stowed position of FIG. 5 (again, without having to disconnect the seat 22 from the garment 14 of the garment assembly 10 in any manner).

The foregoing description of the present invention has been for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A garment assembly, comprising:

a garment comprising a lower edge, the garment comprising separate holes that are configured to receive a left arm and a right arm of a user, the garment having an inner surface and an opposing outer surface, wherein, when the garment is worn by a user, the inner surface faces toward the user and the outer surface faces away from the user;

a seat comprising a top surface, a bottom surface and a rear surface;

two hinging straps, wherein a first end of each hinging strap is connected to the top surface, the bottom surface or the rear surface of the seat and a second end of each hinging strap is connected to the lower edge of the garment, wherein the two hinging straps are configured to remain connected to the seat and to the garment while the seat is pivoted between a vertical stowed position in which the bottom surface of the seat is alongside and faces the outer surface of the garment and a horizontal deployed position beneath the user;

a first upper strap section comprising a first end and a second end, wherein the first end of the first upper strap section is attached to the seat and the second end of the first upper strap section is attached to the garment; and a second upper strap section comprising a first end and a second end, wherein the first end of the second upper strap section is attached to the seat and the second end of the second upper strap section is attached to the garment, wherein the first upper strap section and the second upper strap section are made of an elastic material, wherein the elastic first upper strap section and the elastic second upper strap section are configured to deform to enable pivotal movement of the seat between the vertical stowed position and the horizontal deployed position beneath the user.

2. The garment assembly of claim 1, wherein the garment includes a plurality of pockets.

3. The garment assembly of claim 1, wherein the seat is waterproof.

4. The garment assembly of claim 1, wherein the two hinging straps are non-elastic.

5. The garment assembly of claim 1, wherein the bottom surface of the seat faces a backside of the garment when the seat in the vertical stowed position.

6. The garment assembly of claim 1, wherein each of the two hinging straps includes a buckle to facilitate a detachable interconnection of the seat with the garment.

7. The garment assembly of claim 1, wherein each of the two hinge-straps includes a buckle configured to keep the seat connected to the garment in the vertical stowed position and to keep the seat connected to the garment in the horizontal deployed position beneath the user.

8. A garment assembly comprising:

a garment having an inner surface and an opposing outer surface, wherein, when the garment is worn by a user, the inner surface faces toward the user and the outer surface faces away from the user, the garment comprising separate holes that are configured to receive a left arm and a right arm of the user;

a seat comprising a top surface and a bottom surface, the top surface being configured to support the user in a seated position thereon when the seat is in use, the top surface being generally parallel to the bottom surface, wherein generally parallel is defined as being angularly related so as to be more parallel than perpendicular;

a hinging strap connected between the garment and the seat, one end of the hinging strap being attached to the seat and the other end of the hinging strap being attached to the garment, the hinging strap constructed and arranged to pivotally connect the seat and the garment to enable the seat to be pivoted relative to the garment between a stowed position in which the bottom surface of the seat is alongside and faces the outer surface of the garment and a deployed position in which the seat is disposed at an angle with respect to the outer surface of the garment, when in use, such that the top surface of the seat is configured to support the user in the seated position thereon; and an elastic interconnection, one end of the elastic interconnection being attached to the seat and the other end of the elastic interconnection being attached to the garment, the elastic interconnection configured to elastically deform when the seat is moved between the stowed position and the deployed position, the elastic interconnection being made of an elastic material.

9. The garment assembly of claim 8, wherein the seat further comprises at least an intermediate position between the stowed position and the deployed position.

10. The garment assembly of claim 9, wherein the elastic interconnection is configured to increase in length when the seat is pivoted between the stowed position and the intermediate position, and wherein the elastic interconnection is configured to decrease in length when the seat is pivoted between the intermediate position and the deployed position.

11. The garment assembly of claim 9, wherein the elastic interconnection is configured to stretch to accommodate the pivotal movement of the seat from the stowed position and the intermediate position, and wherein the elastic interconnection is configured to contract to accommodate the pivotal movement of the seat from the intermediate position and the deployed position.

12. The garment assembly of claim 9, wherein the elastic interconnection has a first length when the seat is in the stowed position, wherein the pivotal movement of the seat from the stowed position to the intermediate position stretches the elastic interconnection to a second length, and wherein the elastic interconnection contracts to a third length during the pivotal movement of the seat from the intermediate position to the deployed position.

13. The garment assembly of claim 12, wherein the third length of the elastic interconnection is greater than the first length of the elastic interconnection.

14. The garment assembly of claim 8, wherein the elastic interconnection includes a pair of elastic portions that each interconnect with the garment and that each at least interface or interact with the seat.

15. The garment assembly of claim 14, wherein the seat includes a pair of side surfaces, and wherein the elastic portions interface with the seat at a pair of laterally spaced locations or along each of the two side surfaces of the seat.

16. The garment assembly of claim 8, wherein the elastic interconnection is configured to resiliently bias the seat into engagement with the user when the seat is in the deployed position.

17. The garment assembly of claim 8, wherein the elastic interconnection is configured to resiliently bias the seat against the back of the user-when the seat is in the stowed position.

18. The garment assembly of claim 8, wherein the elastic interconnection is configured to be in tension when the seat is in the stowed position and when the seat is in the deployed position.

* * * * *